US005577755A

United States Patent [19]

Metzger et al.

[11] Patent Number: 5,577,755

[45] Date of Patent: Nov. 26, 1996

[54] ROTATABLE BINDING FOR SNOWBOARD

[75] Inventors: Fritz Metzger, Fallbrook; Ted F. Metzger; Michael E. Metzger, both of Quail Valley, all of Calif.

[73] Assignee: Kuusport Manufacturing Limited, Ontario, Canada

[21] Appl. No.: 273,427

[22] Filed: Jul. 11, 1994

[51] Int. Cl.[6] ..... A63C 9/00

[52] U.S. Cl. ..... 280/607; 280/618; 280/14.2

[58] Field of Search ..... 280/14.2, 601, 280/607, 611, 613, 618, 620, 633, 634, 630, 636

[56] References Cited

U.S. PATENT DOCUMENTS

| | | | |
|---|---|---|---|
| 4,869,522 | 9/1989 | Besnier et al. | 280/607 |
| 5,028,068 | 7/1991 | Donovan | 280/618 |
| 5,188,386 | 2/1993 | Schweizer | 280/607 |
| 5,190,311 | 3/1993 | Carpenter et al. | 280/618 |
| 5,236,216 | 8/1993 | Ratzek | 280/607 |
| 5,261,689 | 11/1993 | Carpenter et al. | 280/618 |
| 5,354,088 | 10/1994 | Vetter | 280/14.2 |

*Primary Examiner*—Anne Marie Boehler

*Attorney, Agent, or Firm*—Sixbey, Friedman, Leedom & Ferguson, PC; Daniel W. Sixbey; Jeffrey L. Costellia

[57] ABSTRACT

A rotatable binding for a snowboard comprises a base plate on the snowboard and a binding plate rotatably mounted on top of the base plate and including a foot binding and a locking assembly for selectively locking, at a desired angle of rotation, the binding plate to the base plate. In a preferred embodiment, the top of the base plate includes an indexing platform including a multiplicity of bores arranged in a circular arc about a central axis and the bottom of the base plate includes a pedestal, having a width about the width of a human foot, traversing the snowboard and supporting the indexing platform above top surface of the snowboard. The locking assembly includes a pin selectively moveable from a raised position, not restricting rotation of the binding plate relative to the base plate to a lowered position engaging an indexing bore such that the binding plate may not rotate relative to the base plate.

10 Claims, 2 Drawing Sheets

ROTATABLE BINDING FOR SNOWBOARD

BACKGROUND OF THE INVENTION

1. Field of the Invention

This invention relates in general to a binding for a snowboard and more specifically to a selectively rotatable binding.

2. Description of the Prior Art

Some conventional snowboard bindings are fixed at an angle relative to the longitudinal axis of the snowboard. Other binding are rotatable at some difficulty in that rotation requires tools and considerable time. Additionally, the boot must be removed from the binding.

It is often desirable to have bindings wherein the angle is easily adjustable.

For example, different users prefer different angles or even a change from left facing to right facing. If users share a snowboard, then the ability to easily change the binding angle is desirable.

Also, a given user may desire to change the binding angle according to the type of ski run to be executed or the speed of the run.

If a snowboard is rented, the binding are adjusted at the rental shop. A user desiring a different angle at a later time must return to the shop for adjustment at a considerable waste of time.

While walking and on the chair lift with one foot captive and the other foot fee, it is particularly desirable to be able to align the binding of the captive foot substantially parallel to the longitudinal axis of the snowboard.

SUMMARY OF THE INVENTION

This invention is a rotatable binding for a snowboard and it generally comprises a base plate on the snowboard and a binding plate rotatably mounted on top of the base plate and including a foot binding and a locking assembly for selectively locking, at a desired angle of rotation, the binding plate to the base plate.

In the preferred embodiment, the top of the base plate includes an indexing platform including a multiplicity of bores arranged in a circular arc about a central axis and the bottom of the base plate includes a pedestal, having a width about the width of a human foot, traversing the snowboard and supporting the indexing platform above top surface of the snowboard.

The locking assembly including a pin selectively moveable from a raised position, not restricting rotation of the binding plate relative to the base plate to a lowered position engaging an indexing bore such that the binding plate may not rotate relative to the base plate. The binding plate is co-axially rotatably mounted on the base plate such that the pin is registrable with the multiplicity of bores.

Markers on the binding plate and base plate indicate alignment of the pin with a bore.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
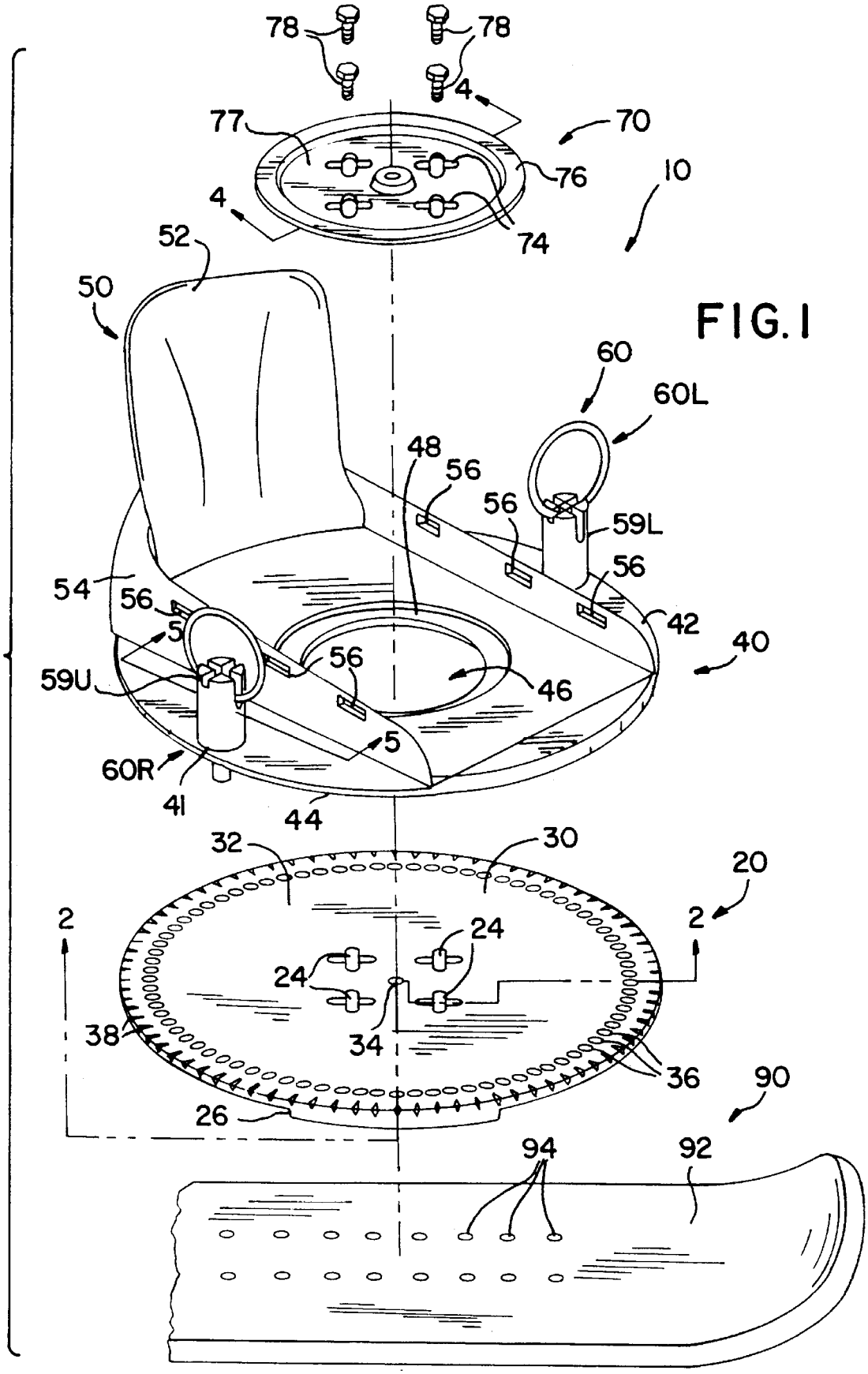
FIG. 1 is an exploded perspective view of the binding of the invention and a section of a snowboard (reduced in size) to which the binding is mounted.

With reference now to the drawings, there is shown in FIG. 1 an exploded perspective view of a preferred embodiment of the binding, denoted generally as 10, of the invention and a section of a snowboard 90, shown reduced in size, to which binding 10 is mounted.

Binding 10 in general comprises a base plate 20, a binding plate 40, and a retainer disk 70. The top 92 of snowboard 90 includes a plurality of longitudinally spaced bores 94 for mounting binding 10 in various longitudinal positions.

Figure 2:
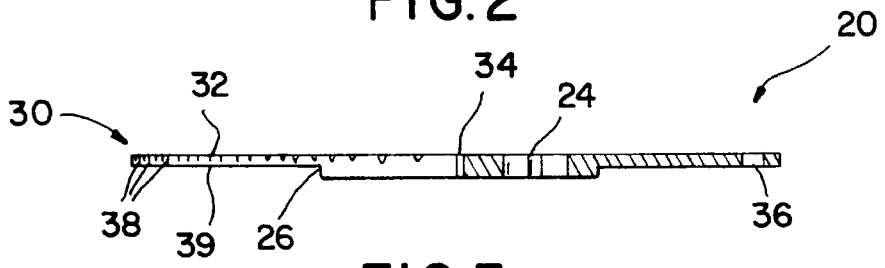
FIG. 2 is a side view of the base plate taken on line 2—2 of FIG. 1.
Figure 3:
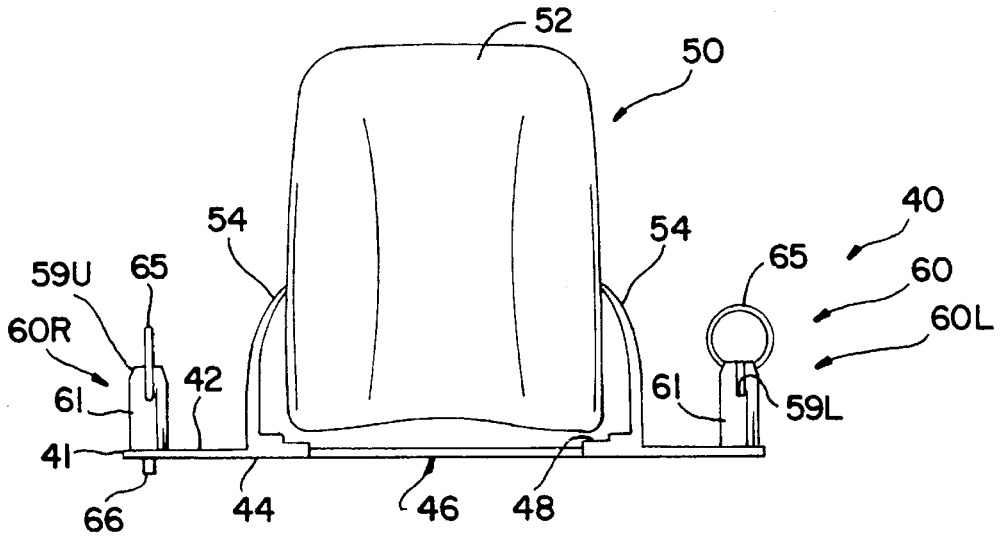
FIG. 3 is a side cross-sectional view of the binding plate of FIG. 1 taken through the locking pins.
Figure 4:
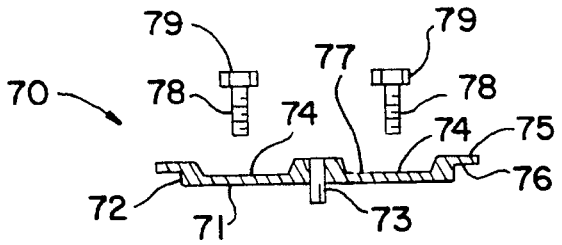
FIG. 4 is a side cross-sectional view of the retainer disk of FIG. 1.
Figure 5:
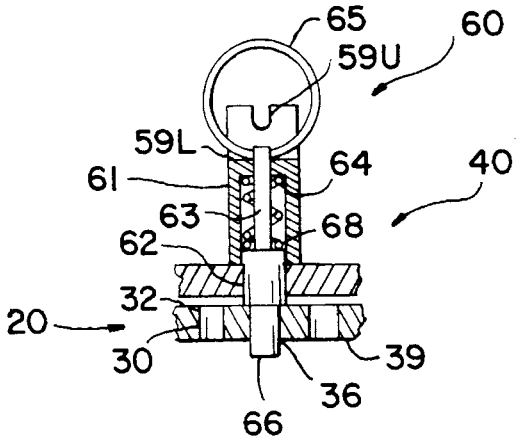
FIG. 5 is an enlarged side cross-sectional view of a locking pin taken on line 5—5 of FIG. 1.

FIG. 2 is a side view of the base plate taken on line 2—2 of FIG. 1. FIG. 3 is a side cross-sectional view of the binding plate of FIG. 1 taken on line 3—3 of FIG. 1 through locking assemblies 60. FIG. 4 is a side cross-sectional view of the retainer disk 70 of FIG. 1. FIG. 5 is an enlarged side cross-sectional view of a locking assembly 60 of FIG. 1.

Base plate 20 is made of strong material, preferably of metal, such as stainless steel, but may be of strong plastic. Base plate 20 may be viewed as including, on its bottom, a pedestal 26 and, as including on its top, an indexing platform 30. It has been found that if platform 30 rests directly on surface 92 of snowboard 90 then the flexibility of snowboard 90 is restricted. Pedestal 26, about the width of a human foot, rests on surface 92, traverses snowboard 90 and supports platform 30 above surface 92 such that the flexibility of snowboard 90 is not significantly impaired by contact during use of board surface 92 with platform 30. Slots 24, passing through base plate 20 and preferably through pedestal portion 26, correspond to the positioning of snowboard bores 94.

The top 32 of platform 30 has a center bore 34 defining a central axis and a multiplicity of indexing bores 36 arranged in a circular arc about the central axis.

Binding plate 40 is rotatably mounted on base plate 20. Binding plate 40 has a top 42 and a bottom 44. Binding plate 40 includes on its top a foot binding 50 for retaining a user's foot to binding plate 40. Foot binding 50 is of common construction and includes heel wall 52 and left and right side walls 54 having a plurality of attachment points, such as holes 56, necessary to attach retainers (not shown), such as cords, laces, straps or the like, for retaining a foot in the binding 50.

A left and a right locking assemblies 60L,60R respectively, are located to the left and right respectively of foot binding 50. Locking assemblies 60L,60R may be attached to the remainder of binding plate 40 or may be molded as an integral part thereof. FIG. 5 is an enlarged side cross-sectional view of a preferred embodiment of locking assembly 60R of FIG. 1 including the its interconnection with base plate 20. As best seen in FIGS. 3 and 5, each locking assembly 60 includes a pin 66 selectively moveable from a raised position, as shown in 60L, not restricting rotation of binding plate relative to said base plate to a lowered position, as shown in 60R, where it engages an indexing bore 36 in base plate 20 such that binding plate 40 may not rotate relative to base plate 20.

As best seen in FIG. 5, locking assembly 60R includes a housing 61 in which pin 66 may move longitudinally vertically. Pin 66 has a lower end 68 that, in its lowered position, extends downward through bore 62 to engage an indexing bore 36 whereby binding plate 40 is prevented from rotation. Biasing means, such as spring 63 that bears against housing shoulder 64 and a pin shoulder 68, resiliently biases pin 66 toward the lowered position.

A ring 65, connected to the upper end of pin 66 is raised and turned by a user to manipulate pin 66. Housing 61 includes a pair of top slots at right angles that terminate as shelves, lower shelf 59L and upper shelf 59U. In the lowered position shown, pin 66 engages indexing bore 36 and ring 65 rests on lower shelf 59L that prevents further downward movement of pin 66. Preferably, in the lowered position, the lower end 67 of pin 66 extends slightly beyond the bottom 39 of base plate platform 30 so that, during flexing of board 90, pin 66 will not become disengaged with base plate 20. Pin 66 is moved to the retracted position by lifting ring 65. Pin 66 then can be retained in the raised position by rotating ring 65 ninety degrees and resting ring 65 on upper shelf 59U. In the locked position, ring 65 parallels the longitudinal axis of board 90 and in the unlocked position ring 65 is at right angles to the longitudinal axis of the board 90. With both left and right pins 66 raised, binding plate 40 may rotate relative to base plate 20. Pins 66 and indexing bores 36 are positioned such that both pins 66 simultaneously align with indexing bores 36. In the preferred embodiment shown, pins 66 are diametrically opposed, but they could be located at other locations on the arc of the circle. Rings 65 are of sufficient diameter such that they may be raised, lowered and turned by a user inserting a gloved finger therethrough.

The center of circular through orifice 46 is equidistant from pins 66. Orifice 46 has an upward facing annular shoulder 48.

Retainer disk 70 is shown in FIGS. 1 and 4. Retainer disk 70 co-axially rotatably mounts binding plate 40 on said base plate 20 such that pins 66 are registrable with indexing bores 36. Retainer disk 70 includes a center disk 72 on its lower side 71 for mating insertion with orifice 46 and a flange 76 on it upper side 75 for mating with orifice shoulder 48. A centering post 73 protrudes downward for the center of disk 72 and is inserted in center bore 34 of base plate 20. In this manner the rotational axis of binding plate 40 is co-linear with the center of the circle of indexing bores 36.

Mounting slots 74 are similar to base plate slots 24 and align therewith. Fasteners, such as bolts 78, disposed through slots 74 and slots 24, engage bores 94 in snowboard 90 to retain binding 10 to snowboard 90 such that binding plate 40 may rotate relative to base plate 20.

Preferably, the top of retainer disk 70 and bolts 78 do not protrude higher than the remainder of the foot supporting area. To achieve this, the top 75 of retainer disk 70 includes a depression 77 adjacent slots 74 so that the top of fasteners, such as bolt heads 79, are at or below the rest of the foot support area.

Slots 24 and 74 allow binding 10 to be moved relative to bolts 78 the length of the slots while binding 10 is mounted on snowboard 90. This permits fine tuning for preferred weight distribution, longitudinally and traversely, by the user on snowboard 90.

Indexing means indicates the alignment of pin 66 to bore 36. A multiplicity of indexing markers 38, preferably one corresponding to each indexing bore 36, lie in a circle outside of the circle of indexing bores 36 such that they can be seen when binding plate 40 is mounted on base plate 20. Indexing markers are intended to indicate the relative rotation of binding plate 40 to base plate 20 and may be any suitable form, such as numbers, notches, and/or colored lines. A pointer 41 on binding plate aligns with an indexing marker to show registry of pin 66 with an indexing bore 36.

Having described the invention, it can be seen that it provides a very convenient device for quickly and easily adjusting the angle of a foot binding relative to a snowboard.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A binding for a snowboard; said binding comprising:

a base plate to be fixedly attached to a top surface of the snowboard;

said base plate having:

a top including an indexing platform including a multiplicity of bores arranged in circular fashion along a circular arc about a central axis;

a binding plate rotatably mounted on said base plate, so as to rotate unobstructedly 360° about an axis of rotation coincident with the central axis of the circular arc of the bores, including:

a bottom;

a top;

a foot binding on said binding plate top;

a locking assembly including:

a pin mounted on the top of said binding plate selectively moveable from a raised position clear of the bottom of the binding plate and not restricting rotation of said binding plate relative to said base plate, to a lowered position extending below the bottom of said binding plate engaging a said bore such that said binding plate may not rotate relative to said base plate; said pin positioned on said base plate such that said pin is registrable in any one of said multiplicity of bores; and mounting means for mounting said binding plate to said base plate so as to permit it to rotate relative thereto.

2. The binding of claim 1 wherein said base plate bottom includes:

a pedestal traversing the snowboard and supporting said indexing platform above the surface of the snowboard.

3. The binding of claim 1 further including:

indexing means for indicating when said pin is aligned with a said bore.

4. The binding of claim 1 wherein:

said base plate includes indexing markers peripheral to said bores indicating the position of said bores; and said binding plate includes a pointer for alignment with an indexing marker to align said pin with a said bore.

5. The binding of claim 1 wherein:

said locking assembly further includes:

a ring attached to said pin for manipulating said pin; said ring of sufficient diameter such that a gloved finger may be inserted therethrough and biasing means to normally urge the pin downwardly into engagement in a said bore.

6. The binding of claim 1 wherein said binding plate includes:

a circular through-orifice having a center to be positioned, in use, directly above the central axis of said base plate.

7. The binding of claim 6 wherein said binding plate includes:

an upward facing annular shoulder surrounding said circular through orifice.

8. The binding of claim 7 wherein:

said mounting means includes:

a retainer disk including:

a lower side;

an upper side;

a center disk, having a center, on said lower side matingly inserted in said through orifice; and a flange on said upper side bearing on said orifice shoulder; and fastener means connecting said retainer disk to said base plate.

9. The binding of claim 8 wherein:

said base plate includes:

a central bore at the central axis; and said retainer disk includes:

a centering post protruding downward from the center of said center disk and inserted through said central bore of said base plate.

10. A binding for a snowboard, said binding comprising:

a base plate to be fixedly attached to a top surface of the snowboard;

said base plate having:

a top including an indexing platform including a multiplicity of bores arranged in circular fashion along a circular arc about a central axis;

a binding plate rotatably mounted on said base plate, so as to rotate unobstructedly 360° about an axis of rotation coincident with the central axis of the circular arc of the bores, including:

a bottom;

a top a foot binding on said binding plate top;

a locking assembly including:

a pin mounted on the top of said binding plate selectively moveable from a raised position clear of the bottom of the binding plate and not restricting rotation of said binding plate relative to said base plate, to a lowered position extending below the bottom of said binding plate engaging a said bore such that said binding plate may not rotate relative to said base plate; said pin positioned on said base plate such that said pin in registrable in any one of said multiplicity of bores; and mounting means for mounting said binding plate to said base plate so as to permit it to rotate relative thereto; and said binding plate having a circular aperture with its center coinciding with the axis of rotation of the binding plate, an annular portion of the retainer disc to fit peripherally, when in position, into the binding plate aperture and act as a guide to the binding plate during its rotation and a peripheral portion of the retainer disc seated on a portion of the top of the binding plate to prevent disengagement of a binding plate from the base plate.

* * * * *